United States Patent [19]

Sakurai

[11] 4,281,627

[45] Aug. 4, 1981

[54] VENTILATOR OF DISTRIBUTOR FOR IGNITION OF ENGINE

[75] Inventor: Toshiyuki Sakurai, Himeji, Japan

[73] Assignee: Mitsubishi Denki Kabushiki Kaisha, Tokyo, Japan

[21] Appl. No.: 136,825

[22] Filed: Apr. 3, 1980

[30] Foreign Application Priority Data

Apr. 3, 1979 [JP] Japan ..... 54/454411[U]

[51] Int. Cl.[3] ..... F02P 1/00

[52] U.S. Cl. ..... 123/146.5 A; 200/19 DC

[58] Field of Search ..... 200/19 DC; 123/146.5 A

[56] References Cited

U.S. PATENT DOCUMENTS

| | | | |
|---|---|---|---|
| 3,678,224 | 7/1972 | Takeda | 123/146.5 A |
| 4,057,045 | 11/1977 | Stellwagen | 123/146.5 A |

FOREIGN PATENT DOCUMENTS

| | | | |
|---|---|---|---|
| 44-19044 | 8/1969 | Japan | 123/146.5 A |
| 53-69638 | 6/1978 | Japan | 123/146.5 A |

*Primary Examiner*—Ronald B. Cox

*Attorney, Agent, or Firm*—Oblon, Fisher, Spivak, McClelland & Maier

[57] ABSTRACT

A ventilator of a distributor for ignition of an engine comprises a ventilation plug molded by an insert molding in a molding of the cap of the distributor. The ventilation plug having a ventilation hole and passage is fixed on the cap in rigid.

4 Claims, 5 Drawing Figures

VENTILATOR OF DISTRIBUTOR FOR IGNITION OF ENGINE

BACKGROUND OF THE INVENTION

1. FIELD OF THE INVENTION

The present invention relates to a ventilator of a distributor for ignition of an engine.

2. DESCRIPTION OF THE PRIOR ARTS

Referring to FIGS. 1, 2 and 3, the conventional distributor will be described.

FIG. 1 shows a distributor having the structure in which a semiconductor amplifying circuit having ignition function is included as a single ignition unit in a housing of the distributor.

In FIG. 1, the reference numeral (1) designates a housing of the distributor which is made of aluminum which has excellent heat radiation property; (2) designates a rotary shaft held by a bearing (3) in the housing (1); (4) designates a cylinder which is freely fitted to the rotary shaft (2); (5) designates a ring signal rotor fitted to the cylinder (4); (6) designates a movable plate which is rotatably held around the rotary shaft (1) to the housing (1); a connecting pin (7) is pivoted at one part of the movable plate and a link (9) of a vacuum leading angle device (8) is freely fitted to the connecting pin (7); (10) designates a stator which is fixed through a permanent magnet (11) on the movable plate (6) and has three projections **(10*a*) which can face to the rotor (5) through each gap. The reference numeral (12) designates a signal unit which is fixed in the housing (1) and which comprises a bobbin (12*a*) and a pair of supporting parts (12*b*); (13) designates a metallic cover held between the upper and lower supporting parts (12*b*). The bobbin (12*a*) and the supporting parts (12*b*) are formed in one piece and the metallic cover (13) is partially buried in the one piece. The reference numeral (14) designates a signal coil which is wound on the bobbin (12*a*) of the signal unit (12); (15) designates a heat sink metallic cover which contains a semiconductor amplifier formed by IC having the ignition circuit function which is partially buried under the ignition unit (not shown); (16) designates a pair of tie screws for fixing the ignition unit and the signal unit (12) in one piece to the housing (1); (17) designates a cam type centrifugal spark advancer leading angle device; (18) designates fitting pieces which are formed at two symmetric places of the centrifugal spark advancer (18); (19) designates a distributor rotor which has a half arm and is fixed to the base of the centrifugal spark advancer (18) and which has an opening (19*a*) having a size for exposing the ignition unitor; (20) designates a pair of tie screws for fixing the distributor rotor (19) by screwing into the screw holes of the centrifugal spark advancer; (21) designates a rotor electrode fixed on the uppart part of the distributor rotor (19); one end of the rotor electrode is brought into slidably contact with a central electrode (22) and the other end of the rotor electrode sequentially face to peripheral electrodes (23); (24) designates a distributor cap which is fitted and fixed in the housing (1) and on which the central electrode (22) and the peripheral electrodes (23) are fixed; (24*a*) designates a cylindrical projection molded in one piece in the molding for the distributor cap; (25) designates a ventilation plug made of rubber which comprises fitting part (25*a*) for fitting to the cyrindrical projection and a cover (25*b*) so as to perform the ventilation in the distributor housing by the ventilation plug and the water proofing and explosion proofing structure in the housing is formed by the cover (25*b*). In the conventional ventilator the cylindrical projection is formed in the molding of the distributor cap (24) shown in FIG. 2 and the fitting part (25*a*) and the cover (25*b*) of the ventilation plug (25) are simultaneously formed with rubber etc. as shown in FIG. 3; and then, the fitting part (25*a*) of the ventilation plug (25)** is fitted to the cylindrical projections of the distributor cap so as to hold the ventilation plug on the cylindrical projection of the distributor cap by the rubber elasticity.

In the conventional ventilator, the ventilation plug (25) has not satisfactory durability because it is made of rubber and the ventilation plug (25) is held on the distributor cap by only rubber elasticity and accordingly, there is a possibility to detach the ventilation plug after the fitting. It has been proposed to fix the ventilation plug to the ventilation hole formed on the distributor cap by a ultrasonic bonding operation. In the latter structure, the ventilation plug is bonded to the distributor cap and accordingly, the disadvantage of the conventional ventilator for detaching the ventilation plug has not been eliminated. It is possible to consider one piece molding of the ventilation plug in the molding of the distributor cap. Thus, the mold for the distributor cap should have a remarkably complicated configuration whereby it has not been practically employed from the viewpoints of the processability and economy.

SUMMARY OF THE INVENTION

The present invention is to provide a ventilator of a distributor for ignition of an engine wherein a ventilation plug is formed by an insert molding in the molding of a cap of the distributor.

DESCRIPTION OF THE PREFERRED EMBODIMENTS

Figure 1:
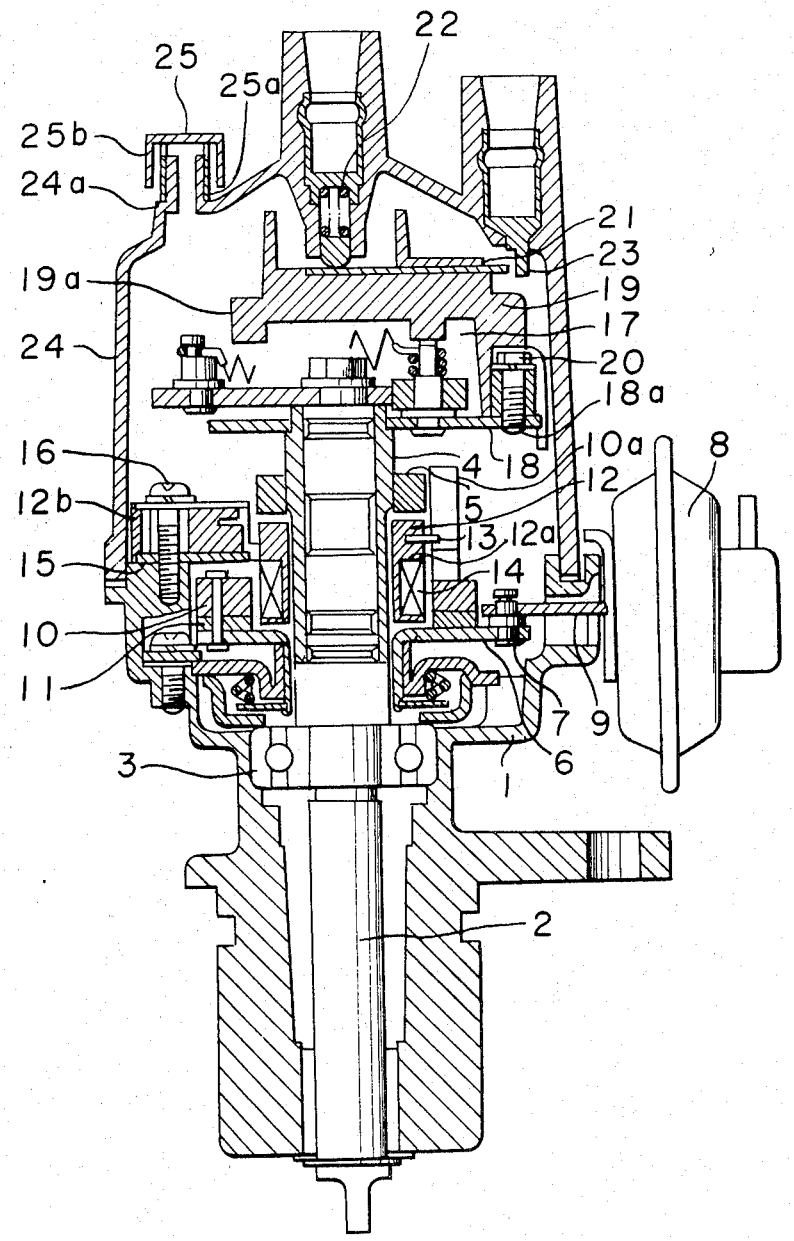
FIG. 1 is a sectional view of the conventional distributor.
Figure 3:
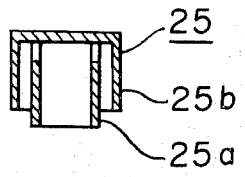
FIGS. 2 and 3 are respectively, partially enlarged sectional views of the important part of the embodiment shown in FIG. 1.
Figure 2:
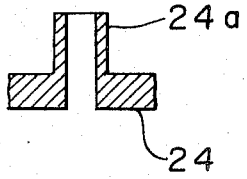
Figure 4:
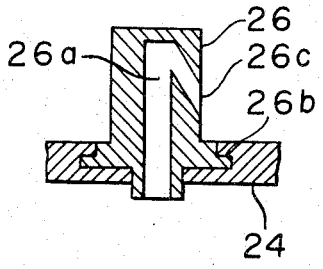
FIGS. 4 and 5 are respectively, partially enlarged sectional views of the important part of embodiments of the present invention.

Referring to FIG. 4, one embodiment of the present invention will be described.

In FIG. 4, the reference numeral (26) designates a ventilation plug molded with a resin which comprises a ventilation hole **(26*c*) for downwardly opening; a ventilation passage (26*a*) for connecting to the ventilation hole (26*c*) and an inserting part (26*b*). The ventilation plug comprising the ventilation passage (26*a*), the inserting part (26*b*) and the ventilation hole (26*c*) is molded. The insert molding of the ventilation plug is carried out in the molding of the cap (24) of the distributor whereby the ventilation plug (26) is formed on the cap of the distributor. The ventilation plug (26)** is fixed in rigid to the cap of the distributor and the ventilation plug is not detached from the cap of the distributor. Moreover, the ventilation plug can be simultaneously formed in the molding of the cap of the distributor to improve processability.

Figure 5:
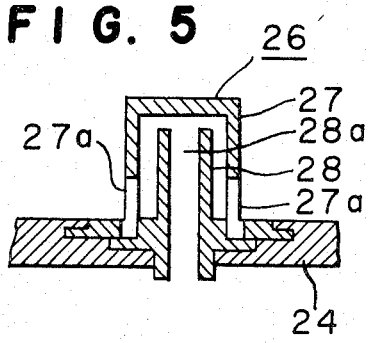

Referring to FIG. 5, the other embodiment of the present invention will be described. In FIG. 5, a cover

(27) having a ventilation hole (27*a*) at a peripheral part near the opening; and a cylindrical part (28) for forming the ventilation passage (28*a*) in the space to the inner wall of the cover are separately molded. The cover (27) is fitted on the bottom of the cylindrical part (28) to form the ventilation plug. The ventilation plug is fixed on the cap of the distributor by the same insert molding as that of FIG. 4.

In accordance with the embodiments of the present invention, the position of the ventilation hole (27*a*) can be varied by adjusting the fitting position of the cover (27) to the cylindrical part (28).

As described above, in accordance with the present invention, the insert molding of the ventilation plug is carried out in the molding of the cap of the distributor, whereby the trouble of the detaching of the ventilation plug can be eliminated. Moreover, the insert molding of the ventilation plug is simultaneously carried out in the molding of the cap of the distributor whereby the processability is remarkably improved and the mold can have a simple configuration to be economical.

I claim:

1. In a ventilator of a distributor for ignition of an engine which comprises a ventilation plug fitted to a cap of said distributor, an improvement characterized in that said ventilation plug and said cap are formed in one piece by an insert molding.

2. A ventilator of a distributor for ignition of an engine according to claim 1 wherein said ventilation plug has a downwardly opened ventilation hole and a ventilation passage for connecting said hole into said cap of the distributor.

3. A ventilator of a distributor for ignition of an engine according to claim 1 wherein said ventilation plug comprises a cover having a ventilation hole on the peripheral part near an opening of said plug and a cylindrical part for forming a ventilation passage connecting to said ventilation hole between said cover and said cylindrical part.

4. A ventilator of a distributor for ignition of an engine according to claim 2 or 3 wherein said ventilation plug is made of a resin.

* * * * *

UNITED STATES PATENT AND TRADEMARK OFFICE

CERTIFICATE OF CORRECTION

PATENT NO. : 4,281,627

DATED : Aug. 4, 1981

INVENTOR(S) : TOSHIYUKI SAKURAI

It is certified that error appears in the above-identified patent and that said Letters Patent are hereby corrected as shown below:

On the cover sheet, Priority Data should read:

[30]--Foreign Application Priority Data

Apr. 3, 1979 [JP] Japan.....54/45441 [U]

Rather than;

[30]--Foreign Application Priority Data

Apr. 3, 1979 [JP] Japan.....54/454411 [U]

As it now appears.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*